US011085136B2

(12) United States Patent
Gonser

(10) Patent No.: US 11,085,136 B2
(45) Date of Patent: Aug. 10, 2021

(54) COMPENSATION ASSEMBLY FOR CIRCULAR BRAIDING MACHINE

(71) Applicant: SIPRA Patententwicklungs- und Beteiligungsgesellschaft mbH, Albstadt (DE)

(72) Inventor: Roland Gonser, Albstadt (DE)

(73) Assignee: SIPRA Patententwicklungs- und Beteiligungsgesellschaft mbH, Albstadt (DE)

( * ) Notice: Subject to any disclaimer, the term of this patent is extended or adjusted under 35 U.S.C. 154(b) by 104 days.

(21) Appl. No.: 16/689,204

(22) Filed: Nov. 20, 2019

(65) Prior Publication Data

US 2020/0165757 A1 May 28, 2020

(30) Foreign Application Priority Data

Nov. 22, 2018 (DE) ..... 202018106642

(51) Int. Cl.
*D04C 3/14* (2006.01)

(52) U.S. Cl.
CPC ..... *D04C 3/14* (2013.01)

(58) Field of Classification Search
CPC ... D04C 3/14; D04C 3/16; D04C 3/18; D04C 5/08
See application file for complete search history.

(56) References Cited

U.S. PATENT DOCUMENTS

| | | | | | |
|---|---|---|---|---|---|
| 1,135,702 | A * | 4/1915 | Larson | B65H 59/04 | 242/156 |
| 4,903,574 | A * | 2/1990 | Brown | B65H 49/26 | 242/156.2 |
| 5,156,079 | A * | 10/1992 | El-Shiekh | D04C 3/14 | 87/57 |
| 5,732,611 | A * | 3/1998 | Voyer | D04C 3/18 | 87/56 |
| 7,862,582 | B2 * | 1/2011 | Ortiz | A61B 17/06061 | 606/216 |
| 2010/0037759 | A1 * | 2/2010 | Baeumer | D04C 3/16 | 87/57 |

* cited by examiner

*Primary Examiner* — Shaun R Hurley
(74) *Attorney, Agent, or Firm* — Laurence A. Greenberg; Werner H. Stemer; Ralph E. Locher

(57) ABSTRACT

A bobbin head assembly for a maypole type circular braiding machine contains a spindle unit, a braiding material spool with braiding material and a bobbin head. The bobbin head contains a compensation plate and a torsion spring extending helically around the extended axis of the spindle unit. The torsion spring has a nose bent radially inwards towards the center at each of the two ends of the torsion spring coils. A spring seat is attached on the compensation plate, for receiving the torsion spring with a spring abutment element for fixing the nose of one spring end in a circumferential direction of the torsion spring. A fixing collar adjustably fixes the nose of the other spring end in the opposite circumferential direction at different positions along the circumferential direction. The position of the fixing collar can be secured in the circumferential direction with respect to the bobbin head.

3 Claims, 6 Drawing Sheets

COMPENSATION ASSEMBLY FOR CIRCULAR BRAIDING MACHINE

CROSS-REFERENCE TO RELATED APPLICATION

This application claims the priority, under 35 U.S.C. § 119, of German application DE 20 2018 106 642.0, filed Nov. 22, 2018; the prior application is herewith incorporated by reference in its entirety.

BACKGROUND OF THE INVENTION

Field of the Invention

The invention relates to an improved bobbin assembly for use in a circular braiding machine working according to the maypole principle.

In a circular braiding machine working according to the maypole principle, a machine type-dependent number of rotors are arranged in a circle around a machine center. The rotors rotate in alternating directions. On their outer circumference, so-called bobbins or spools are guided in recesses called pockets. The bobbins contain the spool receiver with the braiding material spools for the braiding material to be processed. When a bobbin in the pocket of a rotor reaches an adjacent rotor on its circular path, it will be transferred into a pocket of that adjacent rotor and rotates with this rotor in the respective opposite direction to the point of transfer to the next rotor pocket. As a result, the bobbins rotate around the machine center on a wave-like closed path that alternates between lower and upper rotor semicircles. The bobbins, which pass the closed wave-path in one direction, cross the paths of counter-rotating bobbins, which are guided in the pockets of the same rotors but in the respective opposite rotor semicircles. The respective braiding materials are guided from the bobbins to the braiding point by an unwinding device where they are brought together and braided together.

Due to the wave-like rotational movement of the bobbins, the distance between the bobbin and the braiding point in the machine center varies. The distance is the largest when the respective bobbin is at the outermost point of an outer rotor semicircle, and smallest when the bobbin is at the innermost position of an inner rotor semicircle. These maximum and minimum distances define the largest circle and the smallest circle around the machine center. The distance variations between the largest and the smallest circle require a compensation of the length differences in order to obtain and ensure constant tensile forces in the braiding material at the braiding point.

The bobbins therefore comprise so-called compensation assemblies which compensate the tensile force variations through the use of an elastic torsion spring. Due to the constant compensation activity of the torsion springs (caused by the wave path of the bobbins), they are particularly susceptible to wear and breakage. Frequent breakages of torsion springs in a circular braiding machine interrupt the operation, cause costs and reduce efficiency and quality.

SUMMARY OF THE INVENTION

The object of the invention is therefore to find an improved compensation assembly having a torsion spring system that is less susceptible to wear and breakage.

With the foregoing and other objects in view there is provided, in accordance with the invention, a bobbin head assembly for a maypole type circular braiding machine. The bobbin head assembly contains a spindle unit, a braiding material spool for a braiding material, and a bobbin head. The bobbin head includes a compensation plate and a torsion spring extending helically around an extended axis of the spindle unit. The torsion spring has a torsion spring coils with a nose bent radially inwards towards a center at each of two ends of the torsion spring coils including a first spring end and a second spring end. A spring seat has a spring abutment element, and the spring seat is attached on the compensation plate and holds the torsion spring with the spring abutment element for fixing the nose of the first spring end in a circumferential direction of the torsion spring. A fixing collar is provided for adjustably fixing the nose of the second spring end in an opposite circumferential direction at different positions along the circumferential direction of the torsion spring. A position of the fixing collar can be secured in the circumferential direction with respect to the bobbin head.

The specific support of the torsion spring in the bobbin head assembly according to the invention is advantageous in that the strain on the material of the torsion spring due to internal tensions is decreased and, above all, evenly distributed. The avoidance of fixing portions of the spring by fastenings such as clamps ensures that the probability and frequency of spring breakages due to the high strain on the spring because of the high number of tensile force compensations can be strongly reduced. The costs resulting from frequent spring breakages such as purchase and storage of spare parts and costs due to production downtimes are reduced and the productivity, quality and production reliability of the braiding machine are enhanced.

In accordance with an added feature of the invention, except for fixing by the nose, the torsion spring is not further fixed at the ends in the circumferential direction.

In accordance with an additional feature of the invention, a cylindrical wear protector surrounds the torsion spring from an outside. A cylindrical wear protector support surrounds the cylindrical wear protector from the outside, wherein the cylindrical wear protector and the cylindrical wear protector support do not exert an external force on the torsion spring.

Other features which are considered as characteristic for the invention are set forth in the appended claims.

Although the invention is illustrated and described herein as embodied in a compensation assembly for circular braiding machine, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DETAILED DESCRIPTION OF THE INVENTION

Figure 1:
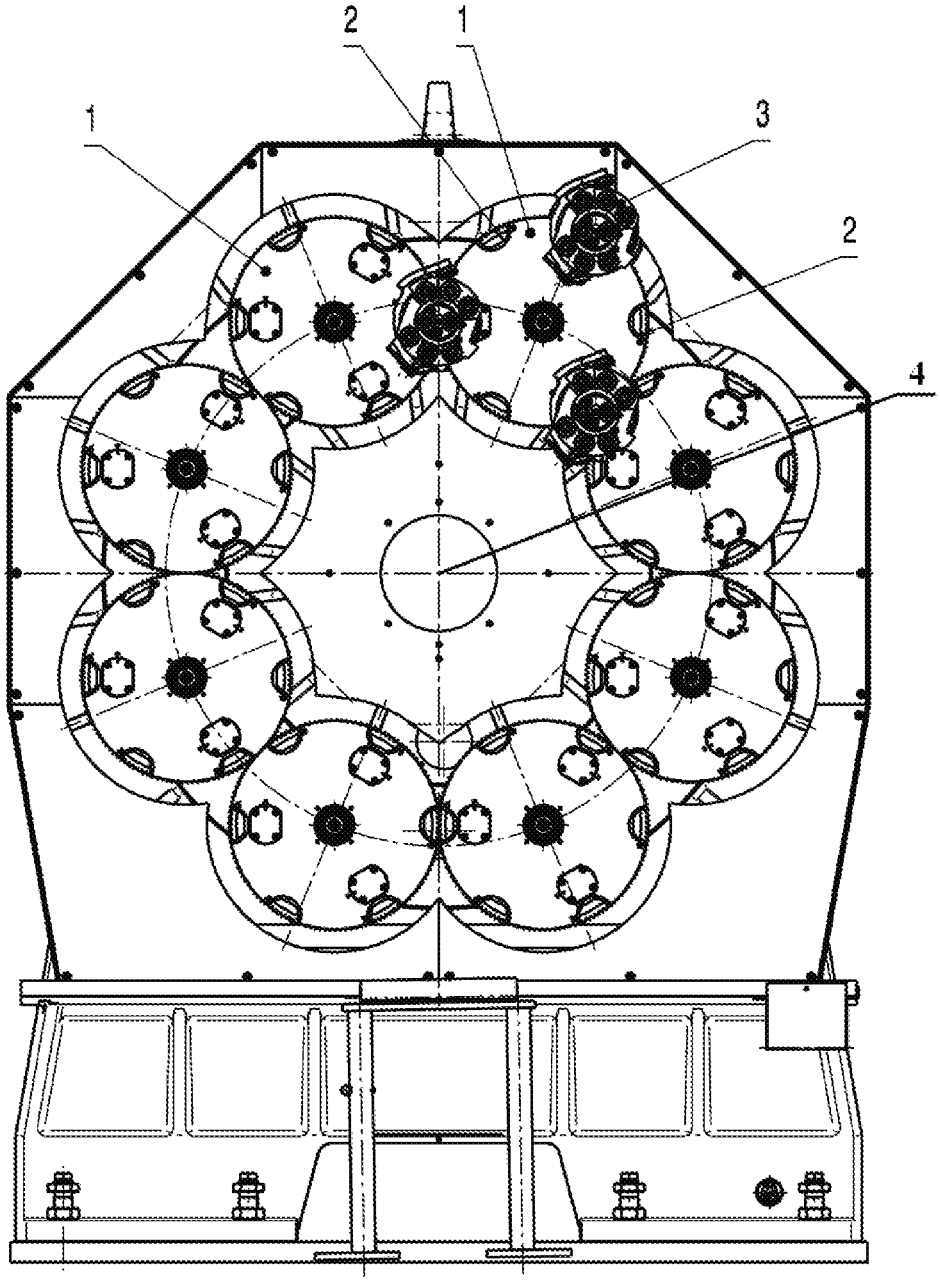
FIG. 1 is a diagrammatic, front view of a braiding frame with eight rotors according to the invention.

Referring now to the figures of the drawings in detail and first, particularly to FIG. 1 thereof, there is shown an example of a braiding frame having eight rotors 1. Each rotor 1 has six rotor pockets 2 for receiving the bobbin 3. In FIG. 1, the alternating directions of rotation of the rotors are indicated by arrows. A braiding machine of this configuration can carry a total of four bobbins 3 with the corresponding bobbin heads. While a group of twelve bobbins 3 rotates around a machine center 4 along a wave-path alternatingly on the inner and the outer rotor semicircles in the clockwise direction, the other half of the bobbins rotates counter-clockwise (the braiding pattern produced by this machine is called "3 over 3").

Figure 2:
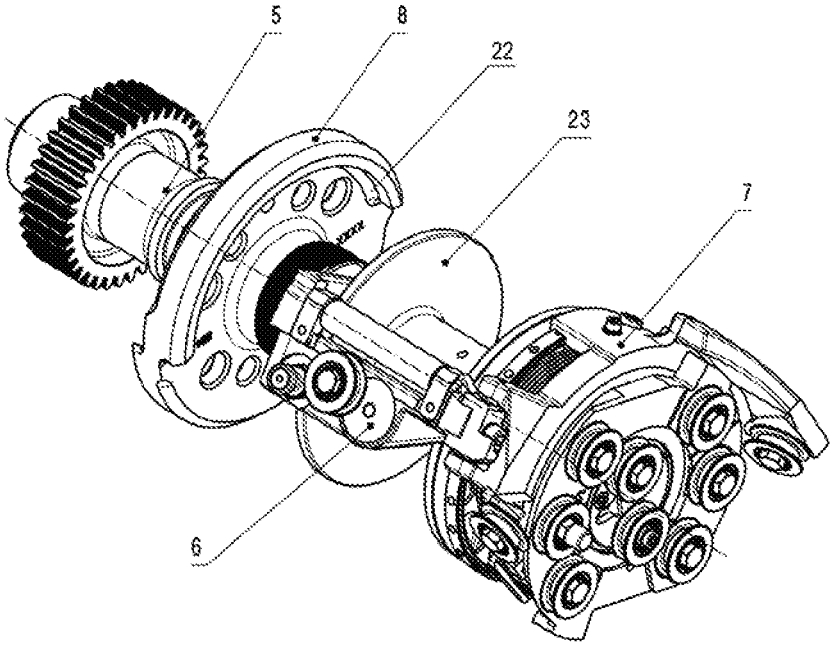
FIG. 2 is a perspective view of a bobbin.

FIG. 2 shows one of the bobbins 3 guided in the rotor pockets 2. The bobbin 3 contains a spindle assembly 5 with a spool support 6 for accommodating the braiding material spool 23, as well as a bobbin head 7. A cam track disc 8 has a front cam track 22 on a front side and a rear cam track 22 on the rear side, on which the cam track disc 8 slides along cams positioned in the rotor. The correct transfer of the bobbin 3 from the pocket of one rotor to that of the next is ensured by changing the guide of the rear cam track 22 to the front or the front to the rear.

Figure 3:
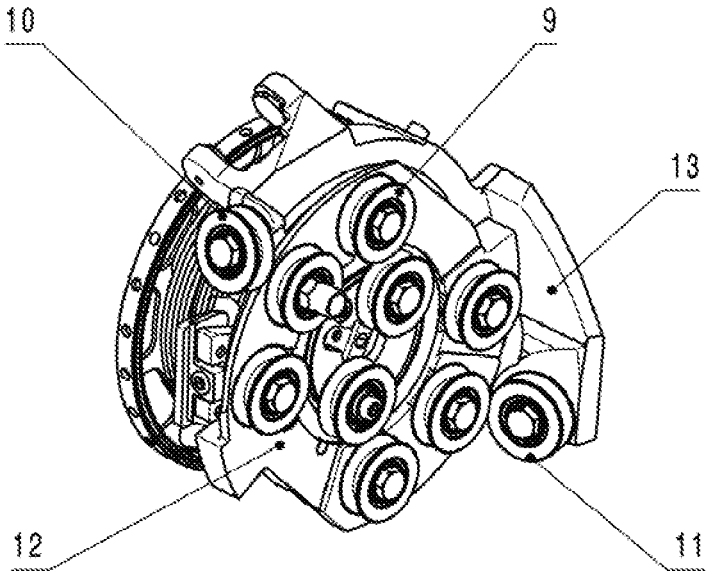
FIG. 3 is a perspective view of a bobbin head.

As shown in FIG. 3, the bobbin head 7 contains a compensation plate 12 with several transport wheels 9 for guiding the braiding material from a supply wheel 10, via which the braiding material is picked up by the bobbin, to a discharge wheel 11, via which the braiding material is discharged from the bobbin head 7 to the braiding point while under tension.

In order to compensate for variations in tensile force due to the rotation of the bobbin on its wave-path, the bobbin head 7 allows a certain amount of rotation of the upper compensation plate 12 against the housing 13, which is fixed to the spindle 5 so that it cannot rotate. If, for example, the bobbin 3 moves on its wave-path from the largest circle to the smallest circle so that the tensile force of the braiding material decreases due to the decreasing distance from the braiding point, the elastic torque of the compensating assembly between the compensating plate 12 and the housing 13 counteracts this drop of tension and thereby maintains the braiding tension.

Figure 4:
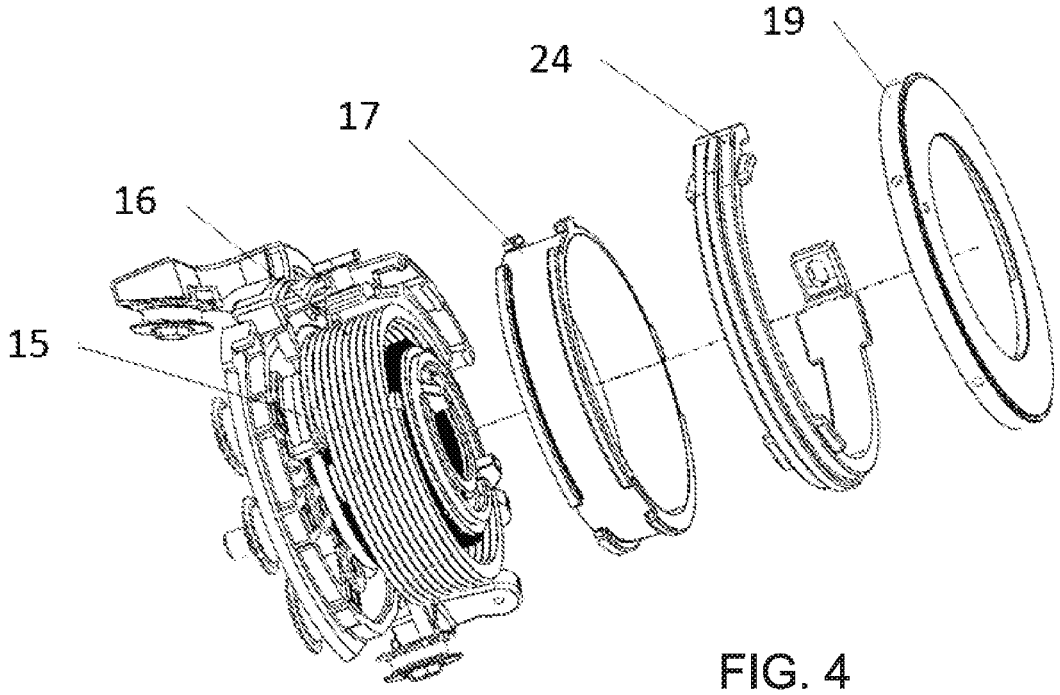
FIG. 4 is an exploded, perspective view of the bobbin head.

FIG. 4 shows an exploded view of the bobbin head. In addition to the compensation plate 12 and the housing 13, the bobbin head contains a compensation assembly which in turn contains a spring seat 15, a torsion spring 16, a wear protector 17, a wear protection holder 24 and a fixing collar 19.

Figure 5:
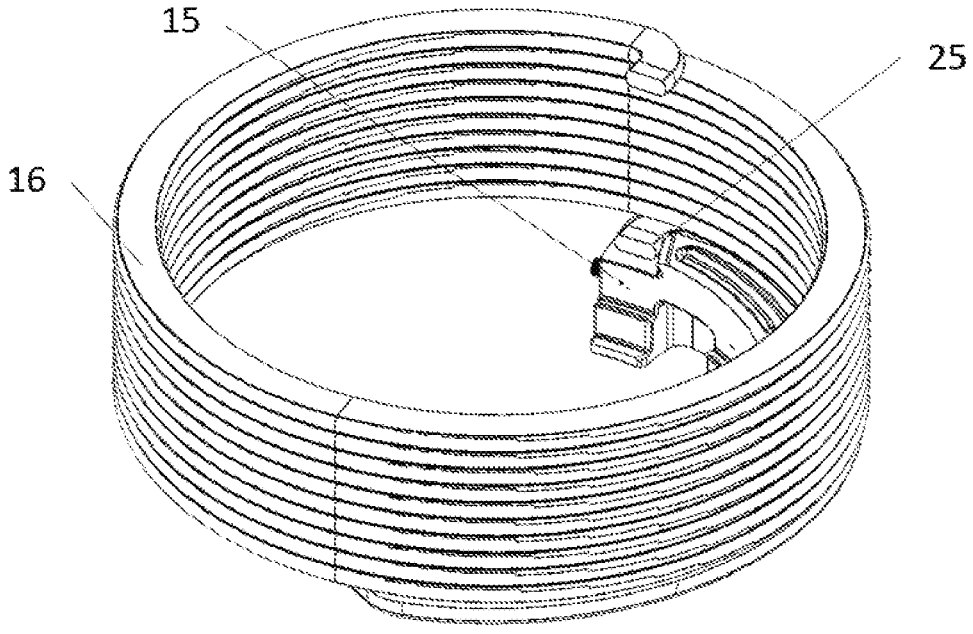
FIG. 5 is a perspective view of a torsion spring in a compensation assembly in the bobbin head and its connection with a spring support at one end of the spring.
Figure 6:
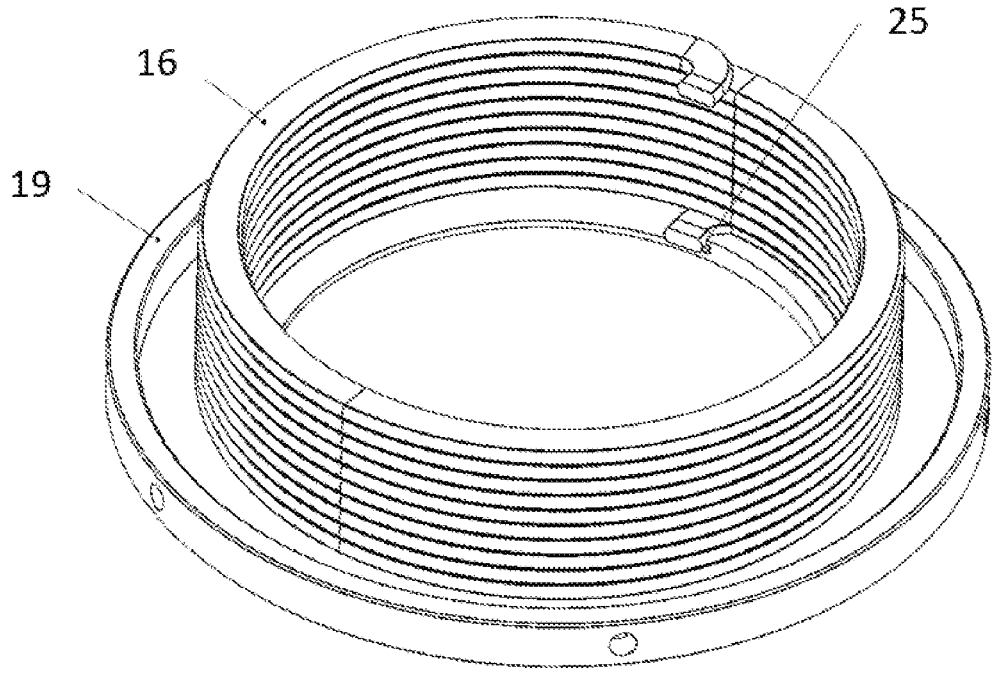
FIG. 6 is a perspective view of the torsion spring in the compensation assembly in the bobbin head and its connection with the fixing collar at the other end of the spring.

The torsion spring 16 has at its ends two noses bent radially inwards towards the center, as can be seen in FIGS. 5 and 6, each showing the connections between the torsion spring 16 and the spring seat 15 at one end and the fixing collar 19 at the other end. The torsion spring 16 can be pretensioned by suitably adjusting or setting the fixing collar by rotating the nose, which abuts the fixing collar, against the other nose which is connected to the compensation plate 12 through the spring seat 15 and fixing it in this position by locking the fixing collar 19.

During operation of the braiding machine, a change in the distance between the bobbin on its wave-path and the braiding point causes a variation of the tensile force of the braiding material. The tensile force of the braiding material is transferred to the spring seat 15 via the discharge, transport and supply wheels on the compensation plate 12 of the bobbin head 7 and thereabove. The resulting counter-rotation of the noses generates a spring force which counteracts the change in tension force and thus compensates it. The tension of the braiding material can thus be kept essentially uniform, which is important for the function and quality of the produced braiding.

Since the desired level of the tension, which should be as uniform as possible, depends on the type and application of the braiding product, it is desirable to also vary the compensation of tensile force changes. Exactly this is possible with the fixing collar 19, which allows the torsion spring 16 to be pretensioned by suitable ration of the noses with respect to each other, for example adapted to the respective braiding material characteristics.

The torsion spring 16 abuts at both ends in the axial direction against the spring seat 15 and against the fixing collar 19. In spring seat 15, the nose abuts against a spring abutment member 25, which fixes the nose in a circumferential direction so that the nose cannot be rotated in this direction. The other nose is fixed in the opposite circumferential direction in the fixing collar 19; in this case, the position of this fixing can be set by rotating the fixing collar and then locking it.

In the radial direction, the torsion spring 16 is restricted externally by the wear protector 17, but without being attached to it. The torsion spring 16 is therefore stored in a floating state in the compensation assembly. Since the torsion spring 16 is thus not exposed to any external force-devices, there is no portion of the spring where the tension in the spring material is particularly high compared to the other spring portions—which would for example be the case in the presence of an external fixation in addition to the persistent extension (opening) and closing of the torsion spring by rotation, where the probability of wear and spring breakage is correspondingly increased.

Figure 7:
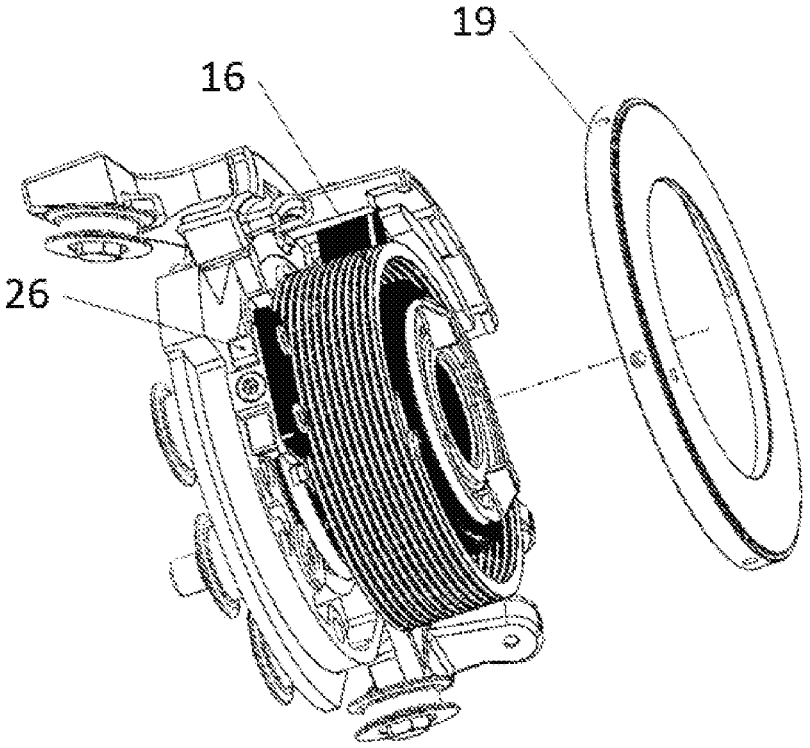
FIG. 7 is a perspective view of a bobbin head comprising a known compensation assembly.
Figure 8:
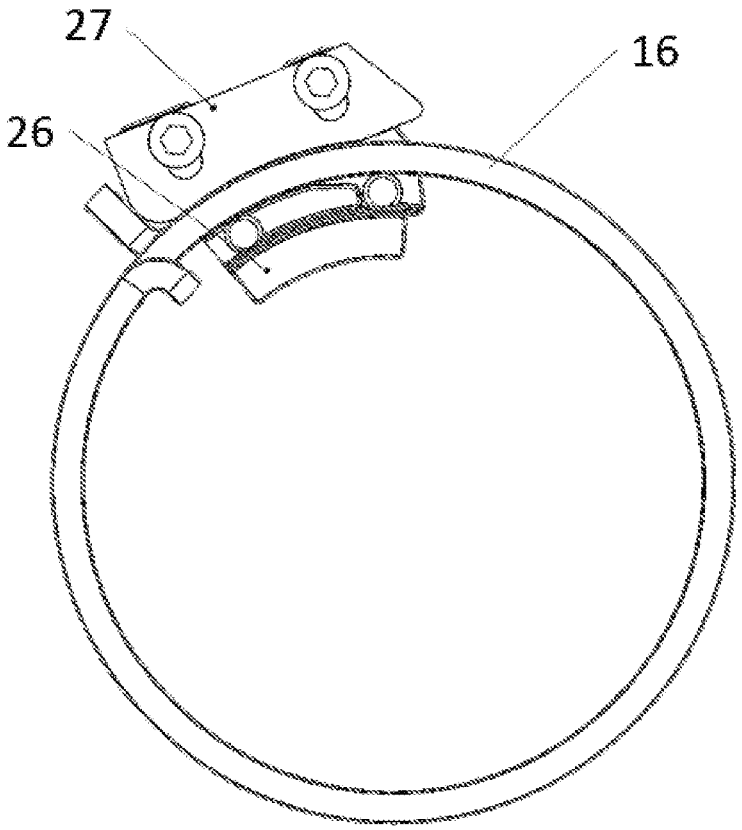
FIG. 8 is a top plan view of the torsion spring and its attachment to the spring support in the known compensation assembly.

This advantage becomes particularly clear when looking at a known design. FIGS. 7 and 8 show such a known configuration in which the torsion spring 16 is fixed by a spring clamp 27 and a spring holder 26 and is attached to the spring seat 15. The spring portion extending between the spring clamp 27 and the spring holder 26, which is clearly observable in FIG. 8, is exposed to particular inner tensions because of the additional attachment, especially at the edges, due to persistent movements of the spring when the spring is rotated in one direction (opening) and the opposite direction (closing). A stronger wear and a greatly increased probability of spring fractures is indeed observed exactly at this portion and directly around it.

The floating support of the torsion spring 16 in the configuration of the example of the invention reduces the tensional strain on the torsion spring 16, which is under a strain due to continued rotational extension (opening) and compression (closing) of the torsion spring, without restricting the mobility by any external fixings. The load on the torsion spring is more uniform, so that spring fractures occur less frequently and are no longer focused on certain critical portions, in particular clamping portions or fixing portions.

In this embodiment, the compensation assembly according to the invention is used in a braiding machine having eight rotors, each containing six rotor pockets and twenty-four bobbins. Of course, the compensation unit can also be used in other braiding machines with different configurations of rotors, rotor pockets, bobbins or spools etc.; the characteristic aspect is the requirement to compensate for variations in tensile force in the braiding material to be processed.

REFERENCE SIGNS

1 rotor
2 rotor pocket
3 bobbin or spool
4 machine center
5 spindle
6 spool support
7 bobbin head
8 cam track disk
9 transport wheel
10 supply wheel
11 discharge wheel
12 compensation plate
13 housing
15 spring seat
16 torsion spring
17 wear protector
19 fixing collar
22 cam track
23 braiding material spool
24 holder/support
25 spring system
26 spring holder
27 spring clamp

The invention claimed is:

1. A bobbin head assembly for a maypole type circular braiding machine, the bobbin head assembly comprising:
- a spindle unit;
- a braiding material spool for a braiding material; and
- a bobbin head, said bobbin head containing:
  - a compensation plate;
  - a torsion spring extending helically around an extended axis of said spindle unit, said torsion spring having torsion spring coils with a nose bent radially inwards towards a center at each of two ends of said torsion spring coils including a first spring end and a second spring end;
  - a spring seat having a spring abutment element, wherein said spring seat is attached on said compensation plate and holds said torsion spring with said spring abutment element for fixing said nose of said first spring end in a circumferential direction of said torsion spring; and
  - a fixing collar for adjustably fixing said nose of said second spring end in an opposite circumferential direction at different positions along the circumferential direction of said torsion spring, wherein a position of said fixing collar can be secured in the circumferential direction with respect to said bobbin head.

2. The bobbin head assembly according to claim 1, wherein, except for fixing by said nose, said torsion spring is not further fixed at said ends in the circumferential direction.

3. The bobbin head assembly according to claim 1, further comprising:
- a cylindrical wear protector surrounding said torsion spring from an outside; and
- a cylindrical wear protector support surrounding said cylindrical wear protector from the outside, wherein said cylindrical wear protector and said cylindrical wear protector support do not exert an external force on said torsion spring.

* * * * *